US005722540A

United States Patent [19]

Laird et al.

[11] Patent Number: 5,722,540

[45] Date of Patent: Mar. 3, 1998

[54] CAN STACKING METHOD AND APPARATUS

[75] Inventors: Linda S. Laird; Larry E. Haney, both of Hutchinson, Kans.; Cynthia Huggins; Jesse A. Huggins, both of Tucson, Ariz.

[73] Assignee: C&L Products, Inc., Hutchinson, Kans.

[21] Appl. No.: 633,142

[22] Filed: Apr. 16, 1996

[51] Int. Cl.[6] ..... B65D 21/02

[52] U.S. Cl. ..... 206/503; 206/821; 220/23.83

[58] Field of Search ..... 206/821, 503, 206/459.5, 508, 806; 220/23.83; 410/47; 414/789.5

[56] References Cited

U.S. PATENT DOCUMENTS

| | | | |
|---|---|---|---|
| 2,661,097 | 12/1953 | Paul | 206/821 |
| 2,687,231 | 8/1954 | Somers . | |
| 3,180,537 | 4/1965 | Collins | 206/821 |
| 3,237,802 | 3/1966 | Wagner | 206/821 |
| 3,275,134 | 9/1966 | Bixler | 206/821 |
| 3,317,087 | 5/1967 | Landis . | |
| 3,422,564 | 1/1969 | Izumi | 206/821 |
| 3,885,672 | 5/1975 | Westenrieder . | |
| 4,308,952 | 1/1982 | Paulucci . | |
| 4,593,818 | 6/1986 | Schenkman . | |
| 4,930,636 | 6/1990 | Meadows . | |
| 5,279,841 | 1/1994 | Yu | 206/821 |
| 5,297,681 | 3/1994 | Gourley . | |

*Primary Examiner*—Jacob K. Ackun
*Assistant Examiner*—Luan K. Bui
*Attorney, Agent, or Firm*—Litman, McMahon & Brown, L.L.C.

[57] ABSTRACT

A can stacking method includes inserting a can stacker insert between each pair of cans in a stack. Each insert has a maximum side to side dimension which is slightly less than the diameter of the cans being stacked and a thickness which is preferably equal to or greater than the combined depth of the peripheral flanges surrounding the top and bottom ends of each can. Each insert, due to its combined thickness and diameter, serves to prevent the cans in the stack from shifting horizontally relative to each other, thus maintaining the can stack in vertical alignment. The inserts can be made in a variety of decorative shapes and styles and can also incorporate indicia such as advertising and inspirational or humorous messages, etc.

6 Claims, 1 Drawing Sheet

CAN STACKING METHOD AND APPARATUS

BACKGROUND OF THE INVENTION

1. Field of the Invention

This invention is directed to a can stacking method and apparatus, and, more particularly, to a can stacking method in which a plurality of can stacker inserts are provided which inserts are slightly smaller in side to side dimension than an inside diameter of a top perimeter flange of each can in a stack. An insert is placed within the top perimeter flange of a first can and then a second can is stacked on top of the first can. An additional insert is then placed within the top perimeter flange of the second can and a third can is stacked on top of the second can and so on. Each insert prevents the cans above and below it from shifting relative to each other and thus the vertical alignment of a stack of cans is reliably maintained.

2. Description of the Related Art

Foods such as vegetables, soups, sauces, etc. have long been preserved and stored in sealed tin or steel cans. In order to conserve storage space in both retail establishments and home storage, these cans are typically stacked on top of each other in vertical alignment. Such arrangements are inherently unstable since the slightest jostling of cans in a stack can cause the cans to shift relative to each other. If this shift is great enough, the entire stack of cans will collapse.

Numerous devices and techniques have been devised to maintain stacks of cans in vertical alignment. One such device is taught in U.S. Pat. No. 3,317,087 to Landis. The '087 patent shows a circular ring with a "tubular wall" for receiving flanges on a pair of stacked cans. An inwardly projecting flat ring or stop is provided for separating the cans and for maintaining the stacking ring in position between the two cans. A second such device is taught in U.S. Pat. No. 4,593,818 to Schenkman. In the '818 patent, a split plastic ring is formed of a number of interior wedges and an exterior rim which extends upward and downward from the wedges. The rim is adjustable to fit over a can on the bottom and to receive a can on the top such that the cans are locked together.

Still another such device is taught by U.S. Pat. No. 5,297,681 to Gourley. In the '681 patent a plastic ring includes a number of indicia panels arrayed about its circumference spaced from each other by a thinner section of ring. The ring slips over adjacent cans in a stack to hold the cans in vertical alignment while simultaneously displaying the indicia panels.

All of these prior art can stacking rings include a lip or wall which receives the flanges on a can positioned above and below the can stacker. Thus, the size of each of these can stacking rings, with the exception of the '818 patent, must match the can diameter exactly. Although the ring in the '818 patent is designed to be adaptable to a variety of can sizes, it requires a fairly complex, and therefore expensive mold. Furthermore, in each of these can stackers, first a bottom can and then a top can must be individually snapped into place within the ring, a rather laborious process when a large number of cans must be stacked.

It is clear then, that a need exists for a can stacking method and apparatus which works well with a variety of can sizes and which apparatus is simple to mold and produce. Furthermore, the can stacking apparatus should preferably not require individual attachment of a ring to the top and bottom perimeter flanges of the stacked cans, but should still reliably maintain a stack of cans in vertical alignment.

SUMMARY OF THE INVENTION

In the practice of the present invention, a can stacking method and apparatus includes placing a can stacker insert between each pair of cans in a stack. Each insert has a maximum side to side dimension which is slightly less than the inside diameter of the top perimeter flange of the cans being stacked. Each insert also has a thickness which is at least greater than the depth of the top perimeter flange of each can and which is preferably equal to or greater than the combined depth of the top and bottom perimeter flanges of each can. As the cans are being arranged in a vertical stack, an insert is placed within the top perimeter flange of each can just prior to stacking another can on top of it. Each insert, due to its combined thickness and diameter, serves to prevent the cans in the stack from shifting horizontally relative to each other. The inserts can be made from a variety of materials in a variety of decorative shapes and styles and can also incorporate indicia such as advertising and inspirational or humorous messages, etc.

OBJECTS AND ADVANTAGES OF THE INVENTION

The principle objects and advantages of the present invention include: to provide a can stacking method and apparatus; to provide such a method which is simple yet effective in maintaining a stack of cans in vertical alignment; to provide such a method in which an insert is placed within a top perimeter flange of each can prior to stacking a can on top; to provide such an insert with a maximum side to side dimension which is less than the inside diameter of the top perimeter flanges of the cans in the stack; to provide such an insert which has a depth which is greater than the depth of the can top perimeter flange; to provide such an insert which is easily and economically constructed; to provide such an insert which is readily capable of carrying indicia such as advertising or other messages; to provide such an insert which can be shaped in a variety of functional and decorative designs; and to provide such a method and apparatus which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
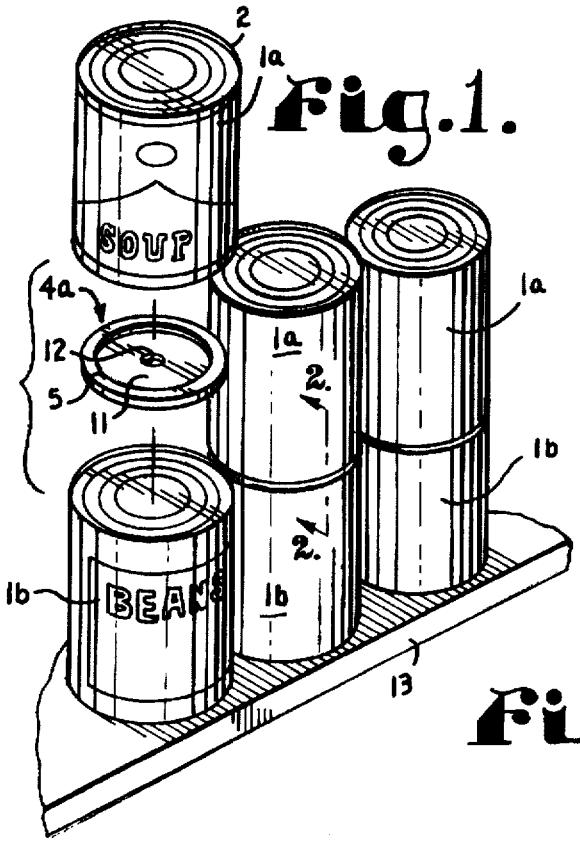
FIG. 1 is a perspective view of a number of stacks of cans with one of the stacks shown with the cans separated and with a first alternative embodiment of a can stacker insert being positioned therebetween.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. The words "inward" and "outward" will refer to directions toward and away from, respectively, the geometric center of the embodiment being described and designated parts thereof. Said terminology will include the words specifically mentioned, derivatives thereof and words of a similar import.

Figure 2:
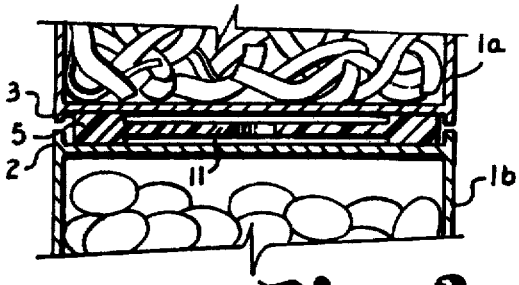
FIG. 2 is an enlarged, fragmentary, cross-sectional view, taken along the line 2—2 of FIG. 1, and showing a portion of a top perimeter flange of a lower can aligned with a bottom perimeter flange of an upper can and with the can stacker insert of FIG. 1 positioned therebetween.

Referring to the drawings in more detail, FIGS. 1 and 2 illustrate stacks of cans 1*a* and 1*b* with each can 1*a* and 1*b* being cylindrically shaped and including an upper perimeter flange 2 and a lower perimeter flange 3. Each of the flanges 2 and 3 of the cans 1*a* and 1*b* is preferably of the same diameter such that the flanges 2 and 3 can be aligned in a stack.

In accordance with the inventive method, a can stacker insert 4*a* is inserted within the upper flange 2 of each can 1*b* just prior to stacking an additional can 1*a* on top. The can stacker 4*a* includes an annular ring 5 with a thickness which is greater than the depth of one of the top flanges 2, and which is preferably equal to or greater than the combined depth of the upper and lower flanges 2 and 3 of one of the cans 1*a* or 1*b*. The ring 5 also has an outside diameter which is slightly less than the inside diameter of the flanges 2 and 3. The annular ring 5 of the can stacker insert 4*a* encircles a center disc portion 11 which provides enhanced rigidity to the insert 4*a*. A center aperture 12 is provided in the disc 11 for convenience in hanging the inserts 4*a* when they are not in use.

Referring to FIG. 2, the annular ring 5 of the insert 4*a* prevents the lower flange 3 of the upper can 1*a* from shifting horizontally relative to the upper flange 2 of the lower can 1*b*. This insures that jostling of a shelf 13 or of the cans 1*a* or 1*b* themselves will not result in knocking the upper can 1*a* out of alignment with the lower can 1*b*. In other words, the upper can 1*a* must be physically lifted above the annular ring 5 in order for it to be shifted horizontally. Thus, the cans 1*a* and 1*b* are reliably maintained in vertical alignment with each other by the insertion of an insert 4*a* between each successive pair of cans 1*a* and 1*b*. Of course, although stacks of only two cans are shown, any desired number of cans 1*a* and 1*b* can be stacked atop each other via the inventive method by placing inserts 4*a* between each successive pair of cans 1*a* and 1*b*. It should be noted, however, that experimentation has shown that, for typical kitchen can sizes, the inventive method is effective for a maximum stack of approximately 12 cans.

Figure 3:
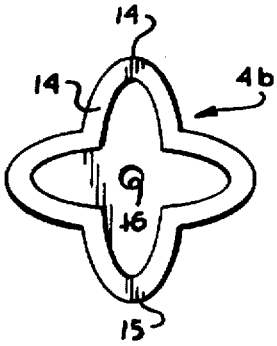
FIGS. 3, 4, 5 and 6 each illustrate a different alternative embodiment of can stacker insert.

Referring to FIGS. 3–6, a number of different alternative embodiments of can stacker insert are illustrated. FIG. 3 illustrates a second alternative embodiment insert 4*b* which is butterfly shaped with a perimeter segment 14 made up of a plurality of "wings" 15 which segment 14 is preferably the same thickness as the annular ring 5 of the insert 4*a*. The maximum distance across the butterfly wings 15 from tip to tip is preferably the same as the outside diameter of the annular ring 5 of the insert 4*a*, i.e slightly smaller than the inside diameter of the top perimeter flange 2 of the cans to be stacked. An aperture 16 is provided, again for convenience in storing the inserts 4*b*.

Figure 4:
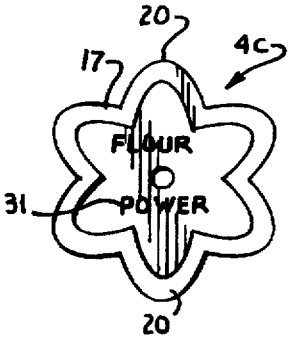

FIG. 4 illustrates a third alternative embodiment insert 4*c* which is flower shaped with a perimeter segment 17 made up of a plurality of "petals" 20 which segment 17 is preferably the same thickness as the annular ring 5 of the insert 4*a*. The maximum distance across the petals 20 from tip to tip is preferably the same as the outside diameter of the annular ring 5 of the insert 4*a*. An aperture 21 is provided, again for convenience in storing the inserts 4*c*.

Figure 5:
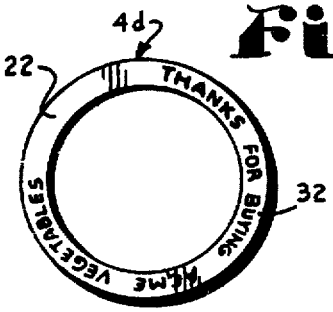

FIG. 5 illustrates a fourth alternative embodiment insert 4*d* which is just an annular ring 22 with no interior disc. The thickness and the diameter of the ring 22 are preferably the same as that of the annular ring 5 of the insert 4*a*.

Figure 6:
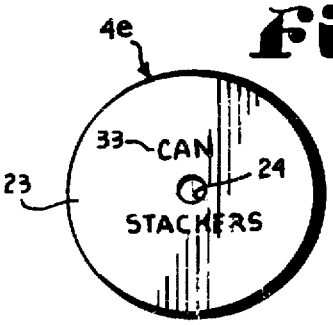

Finally FIG. 6 illustrates a fifth alternative embodiment insert 4*e* which is a solid cylindrical disc 23. Again, the thickness and the diameter of the disc 23 are preferably the same as that of the annular ring 5 of the insert 4*a*. An aperture 24 is illustrated for facilitating hanging of the inserts 4*e*.

FIGS. 4, 5 and 6 illustrate various indicia 31, 32 and 33, respectively, which can be included on the inserts 4*c*–4*e*. Virtually any indicia, including alphanumeric printing and/or decorative designs, can be placed on any of the inserts 4*a*–4*e*.

The shapes of can stacker inserts 4*a*–4*e* are merely illustrative and an infinite variety of other shapes are possible including, but not limited to, star shapes, three legged or triangular shapes, square, rectangular and diamond shapes, oval shapes, parallelogram shapes, trapezoidal shapes, etc. Furthermore, the inserts can include various shapes of cut-outs within a disc such as 4*a* or 4*e* to add visual interest. The only limiting qualifiers for the selected shape are that the overall maximum side to side dimension must be less than the inside diameter of the top perimeter flange of the cans being stacked and the thickness should preferably be equal to or greater than the combined depth of the can flanges 2 and 3 but, at a minimum, greater than the depth of the can flange 2. Of course, the thickness and the diameter of the inserts 4*a*–4*e* can be varied to match the size and the flange depth of the cans 1*a* and 1*b* being stacked. The can stacker inserts 4*a*–4*e* can be made of a variety of materials, including, but not limited to, molded plastic, wood, cardboard, cardboard with glossy paper coating and design, cork, woven straw, rubber, etc. For ease of illustration, stacks of only two cans have been shown but it should again be noted that stacks of any number of cans can be effectively maintained by the inventive method and apparatus, subject to the limitation earlier mentioned.

It is thus to be understood that while certain forms of the present invention have been illustrated and described herein, it is not to be limited to the specific forms or arrangement of parts described and shown.

What is claimed and desired to be secured by Letters Patent is as follows:

1. A can stack with a first and second can and a stacker insert disc designed to stack and securely maintain said first can to said second can in a vertical stacked relationship, each of the first and second cans including a top perimeter flange of a first depth and a bottom perimeter flange of a second depth, the top and bottom perimeter flanges having the same inside diameter, said can stack comprising:

a. said first and second cans arrayed in a substantially vertical alignment with said bottom perimeter flange of said first can being aligned with said top perimeter flange of said second can and said insert disc comprising:

i. a perimeter segment, said perimeter segment having an outside surface and being sized such that a maximum distance from outside surface to outside surface of said perimeter segment is slightly less than the inside diameter of said top and bottom flanges of said first and second cans, said perimeter segment having a third depth which is equal to or greater than the combined depth of the top perimeter flange and a bottom perimeter flange of one of said cans;

ii. a center web segment interconnecting said perimeter segment, said center web segment having a fourth depth less than said third depth; and iii. an aperture extending through said center web segment, said aperture being sized to allow storage or hanging of said insert discs.

2. A can stack and can stacker insert disc as in claim 1, wherein said perimeter segment of said insert has a circular shape with an outside diameter being slightly less than the inside diameter of one of said top perimeter flanges.

3. A can stack and can stacker insert disc as in claim 1, said insert comprising indicia thereon.

4. A can stack and can stacker insert disc as in claim 1, wherein said perimeter segment of said insert disc has a butterfly shape with a plurality of wings with tips, said wings being arranged such that a circle which touches each of said tips of each said wings has a diameter which is slightly less than the inside diameter of one of said top perimeter flanges.

5. A can stack and can stacker insert disc as in claim 1, wherein said perimeter segment of said insert has a flower shape with a plurality of petals with the maximum distance from tip to tip of said petals being slightly less than the inside diameter of one of said top perimeter flanges.

6. A can stack with a first and second can and a stacker insert disc designed to stack and securely maintain said first can to said second can in a vertical stacked relationship, each of the first and second cans including a top perimeter flange of a first depth and a bottom perimeter flange of a second depth, the top and bottom perimeter flanges having the same inside diameter, said can stack comprising:

a. said first and second cans arrayed in a substantially vertical alignment with said bottom perimeter flange of said first can being aligned with said top perimeter flange of said second can and said insert disc comprising:

i. a perimeter segment, said perimeter segment having a flower shape with a plurality of petals with tips, said petals being arranged such that a circle which touches each of said tips of each said petals has a diameter which is slightly less than the inside diameter of said top and bottom perimeter flanges, said perimeter segment having a third depth which is equal to or greater than the combined depth of the top perimeter flange and a bottom perimeter flange of one of said cans;

ii. a center web segment interconnecting said perimeter segment, said center web segment having a fourth depth less than said third depth; and iii. an aperture extending through said center web segment, said aperture being sized to allow storage or hanging of said insert discs.

* * * * *